US012426717B2

(12) United States Patent
Chung

(10) Patent No.: US 12,426,717 B2
(45) Date of Patent: Sep. 30, 2025

(54) FOLDABLE BED

(71) Applicant: ULIFE HEALTHCARE INC., Taoyuan (TW)

(72) Inventor: Ya-Hsin Chung, Taichung (TW)

(73) Assignee: ULIFE HEALTHCARE INC., Taoyuan (TW)

( * ) Notice: Subject to any disclaimer, the term of this patent is extended or adjusted under 35 U.S.C. 154(b) by 126 days.

(21) Appl. No.: 18/544,807

(22) Filed: Dec. 19, 2023

(65) Prior Publication Data

US 2025/0120510 A1 Apr. 17, 2025

(30) Foreign Application Priority Data

Oct. 17, 2023 (TW) ..... 112211138

(51) Int. Cl.
*A47C 19/12* (2006.01)

(52) U.S. Cl.
CPC ..... *A47C 19/12* (2013.01)

(58) Field of Classification Search
CPC ..... A47C 20/08; A47C 17/70; A47C 17/74; A47C 19/12; A47C 19/122; A47C 20/10
See application file for complete search history.

(56) References Cited

U.S. PATENT DOCUMENTS 9,895,003 B2 * 2/2018 Choi ..... A47C 19/04
10,694,860 B2 * 6/2020 Jin ..... A47C 17/70
2014/0366267 A1 * 12/2014 Suh ..... A47C 20/041 5/174
2019/0223609 A1 * 7/2019 Sherman ..... A47C 27/14
2020/0178695 A1 * 6/2020 Shih ..... A47C 20/041
2020/0187662 A1 * 6/2020 Zeng ..... A47C 19/122
2020/0205576 A1 * 7/2020 Choi ..... A47C 20/041
2020/0237105 A1 * 7/2020 Eskridge, III ..... A47C 27/14
2020/0359804 A1 * 11/2020 Lee ..... A47C 19/122
2022/0095802 A1 * 3/2022 Chen ..... A47C 20/041
2022/0248864 A1 * 8/2022 Shan ..... A47C 19/122
2022/0312980 A1 * 10/2022 Shan ..... A47C 19/12
2022/0354265 A1 * 11/2022 Wang ..... A47C 19/122
2022/0369822 A1 * 11/2022 Ma ..... A47C 19/122
2023/0050413 A1 * 2/2023 Chung ..... A47C 20/12
(Continued)

FOREIGN PATENT DOCUMENTS

CN 216089751 U * 3/2022 ..... A47C 21/006
WO WO-2017044116 A1 * 3/2017 ..... A47C 20/041

*Primary Examiner* — David E Sosnowski
(74) *Attorney, Agent, or Firm* — Michael Best & Friedrich LLP

(57) ABSTRACT

A foldable bed includes a first frame unit, a second frame unit and a first electric driver. The first frame unit has two first outboard rods and two first inboard rods. The second frame unit is connected with the first frame unit, and has two second outboard rods and two second inboard rods. Each second outboard rod is spaced apart from an adjacent second inboard rod to define a rod receiving space therebetween. When the first and second frame units are in a folded state, each first outboard rod and an adjacent first inboard rod are received in the rod receiving space. In the folded state, a folded height of the first and second frame units is sum of a height of one second outboard rod, a height of a first panel assembly and a height of a second panel assembly so as to reduce the folded height.

9 Claims, 12 Drawing Sheets

(56) References Cited

U.S. PATENT DOCUMENTS

| | | | | |
|---|---|---|---|---|
| 2023/0200546 | A1* | 6/2023 | Shih | A47C 20/041 5/174 |
| 2023/0225518 | A1* | 7/2023 | Huang | A47C 20/041 5/174 |
| 2023/0404273 | A1* | 12/2023 | Ma | A47C 20/041 |
| 2024/0099472 | A1* | 3/2024 | Deng | A47C 20/041 |
| 2024/0130536 | A1* | 4/2024 | Deng | A47C 20/041 |
| 2024/0197076 | A1* | 6/2024 | Chung | A47C 19/12 |
| 2024/0197077 | A1* | 6/2024 | Shih | A47C 20/041 |
| 2024/0206628 | A1* | 6/2024 | Xu | A47C 29/003 |
| 2024/0206633 | A1* | 6/2024 | Shih | A47C 20/041 |

* cited by examiner

FOLDABLE BED

CROSS-REFERENCE TO RELATED APPLICATION

This application claims priority to Taiwanese Patent Application No. 112211138, filed on Oct. 17, 2023, and incorporated by reference herein in its entirety.

FIELD

The disclosure relates to a foldable bed, and more particularly to a foldable bed with a reduced height when folded.

BACKGROUND

With reference to FIGS. 1 and 2, a conventional foldable electric bed as disclosed in US 2020/178695 includes a first unit 11, a second unit 12, two hinges 13 interconnecting the first and second units 11, 12, and a plurality of leg posts 14 removably mounted on bottoms of the first and second units 11, 12. The first unit 11 has a front fixed frame 111 and a front movable frame 112 pivotably connected with the front fixed frame 111. The second unit 12 has a rear fixed frame 121 and a rear movable frame 122 pivotably connected with the rear fixed frame 121. One end of each hinge 13 is securely disposed on a rear side of the first unit 11, and the other end is securely disposed on a front side of the second unit 12. In a horizontal state (see FIG. 1) of the foldable electric bed, the leg posts 14 stand on the ground surface, and top surfaces of the first and second units 11, 12 are located on an imaginary plane. To fold the foldable electric bed to a folded state (see FIG. 2), the leg posts 14 are removed, and the first unit 11 is rotated about a central axis of the hinges 13 that is above the imaginary plane relative to the second unit 12 to reduce the volume thereof in order to facilitate packaging, transportation and storage.

Referring to FIG. 2, in the folded state, the front fixed frame 111 and the front movable frame 112 are overlapped with the rear fixed frame 121 and the rear movable frame 122 in an up-down direction, which results in the folded bed having a relatively large height which undermines the aim of reducing of packaging volume.

SUMMARY

Therefore, an object of the disclosure is to provide a foldable bed that can have a reduced height when folded.

According to the disclosure, the foldable bed includes a first frame unit, a second frame unit and a first electric driver. The first frame unit includes a first frame and a first panel assembly. The first frame has two first outboard rods which are spaced apart from each other in a left-right direction and each of which extends in a front-rear direction to have front and rear ends, two first overlapping rods which respectively interconnect the front ends and the rear ends of the first outboard rods, and a first inboard frame assembly which is surrounded by the first outboard rods and the first overlapping rods. The first inboard frame assembly has two first inboard rods which extend in the front-rear direction. The first panel assembly is disposed and supported on the first frame in an up-down direction. The second frame unit is connected with the first frame unit in the front-rear direction, and includes a second frame and a second panel assembly. The second frame has two second outboard rods, each of which extends in the front-rear direction to have front and rear ends and has a height measured in the up-down direction and ranging from 55 mm to 65 mm, two second overlapping rods which respectively interconnect the front ends and the rear ends of the second outboard rods, and a second inboard frame assembly which is surrounded by the second outboard rods and the second overlapping rods. The second outboard rods are spaced apart from each other in the left-right direction by a distance which is larger than a distance between the first outboard rods. The second inboard frame assembly has two second inboard rods which extend in the front-rear direction. Each of the second outboard rods is spaced apart from an adjacent one of the second inboard rods to define a rod receiving space therebetween. The second panel assembly is disposed and supported on the second frame in the up-down direction. The first electric driver is actuated to drive movement of the first panel assembly or the second panel assembly. The first and second frame units are shiftable between an unfolded state, where the first and second frame units are spreaded relative to each other in the front-rear direction, and a folded state, where the first and second frame units are overlapped with each other in the up-down direction, and each of the first outboard rods and an adjacent one of the first inboard rods are received in the rod receiving space. In the folded state, the first and second frame units define a folded height which is measured in the up-down direction and which is a sum of a height of one of the second outboard rods, a height of the first panel assembly and a height of the second panel assembly.

With the first outboard rods and the first inboard rods received in the rod receiving spaces, the folded height is reduced in the folded state so as to reduce the packaging volume and transportation and storage costs.

BRIEF DESCRIPTION OF THE DRAWINGS

Other features and advantages of the disclosure will become apparent in the following detailed description of the embodiment with reference to the accompanying drawings. It is noted that various features may not be drawn to scale.

DETAILED DESCRIPTION

Figure 1:
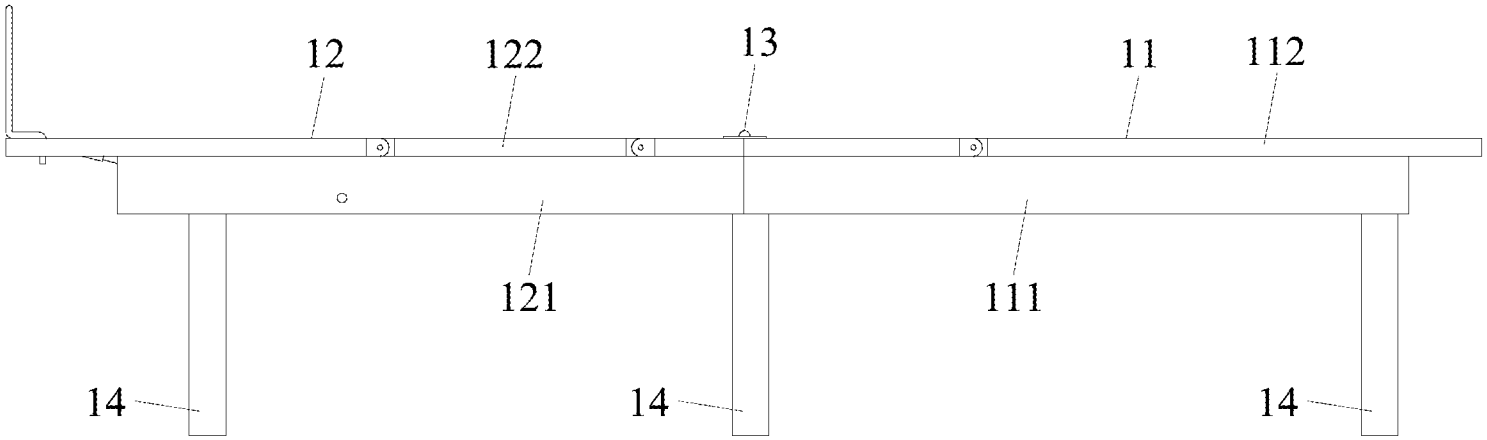
FIG. 1 PRIOR ART
FIG. 1 is a schematic side view of a conventional foldable electric bed in an unfolded state.
Figure 2:
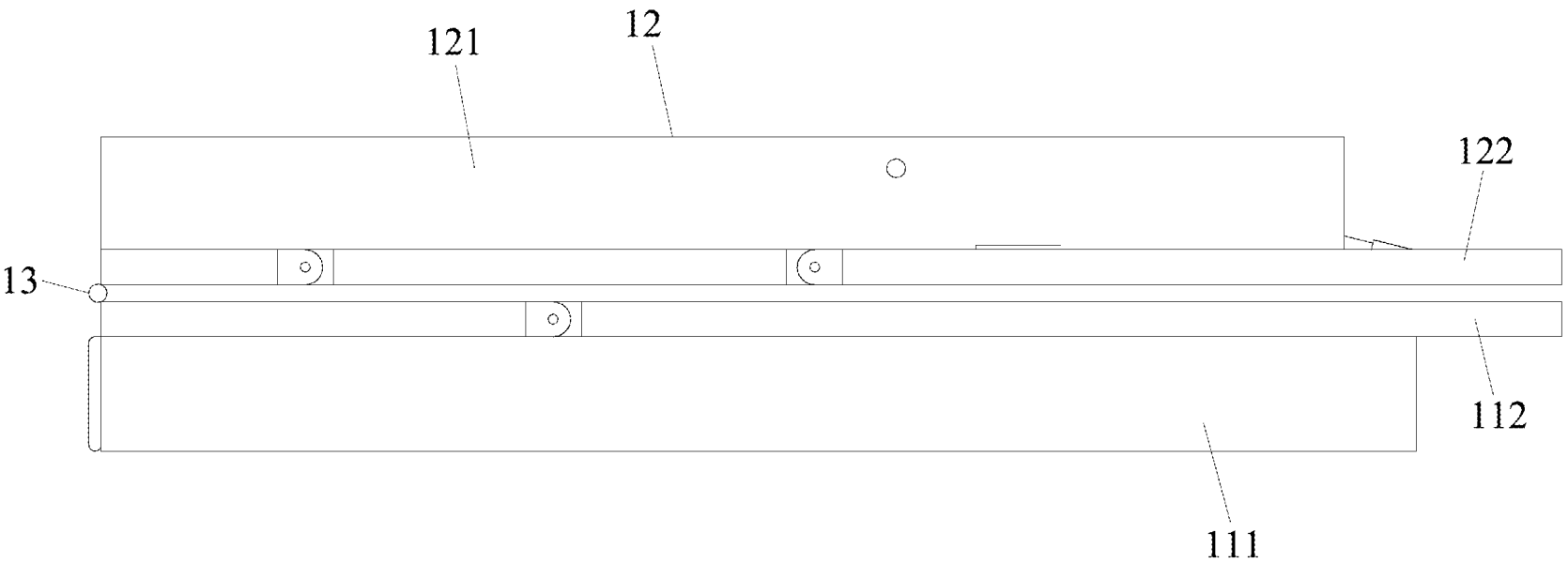
FIG. 2 PRIOR ART
FIG. 2 is a schematic side view of the conventional foldable electric bed in a folded state.

It should be noted herein that for clarity of description, spatially relative terms such as "top," "bottom," "upper,"

"lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 3:
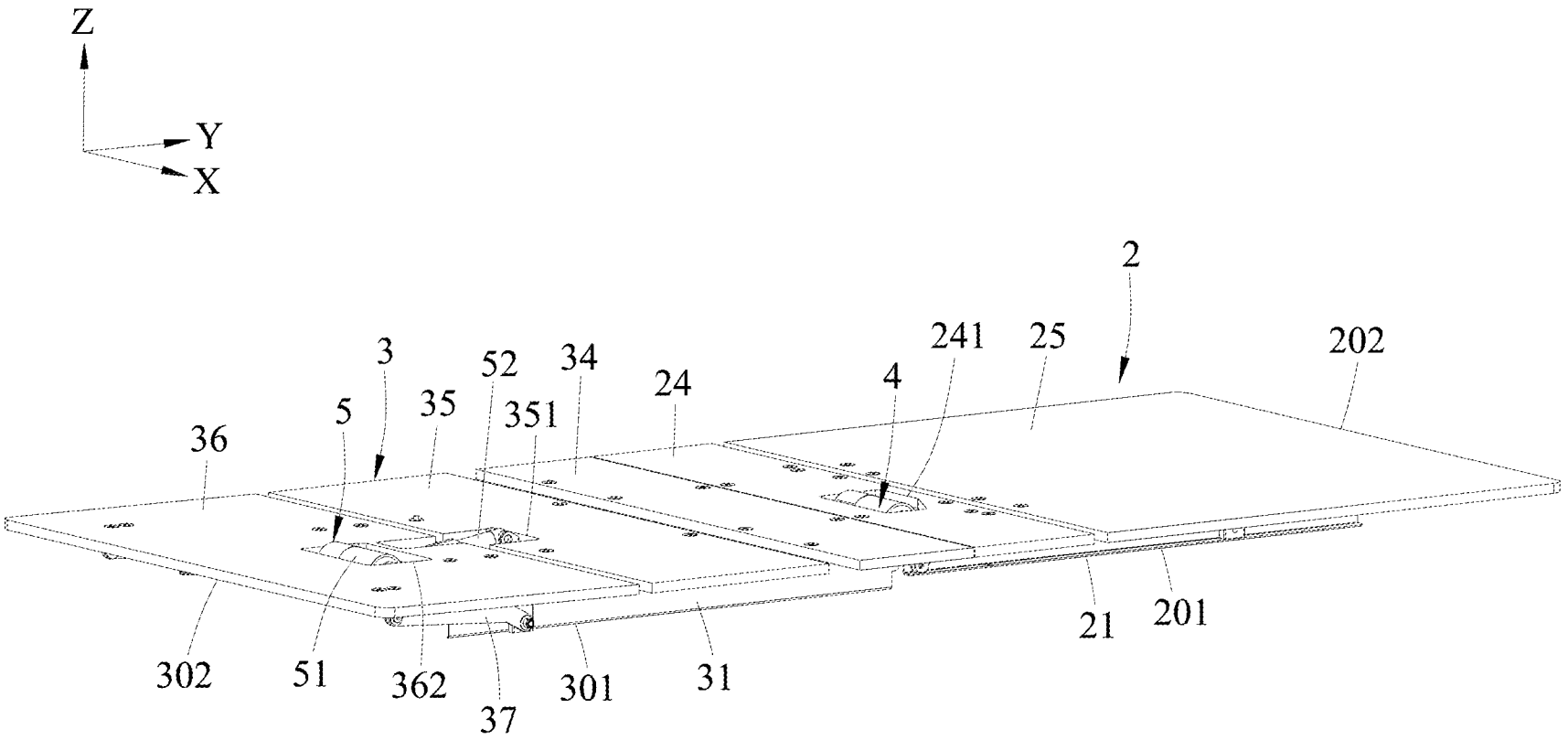
FIG. 3 is a perspective view illustrating an embodiment of a foldable bed according to the disclosure in an unfolded state.
Figure 4:
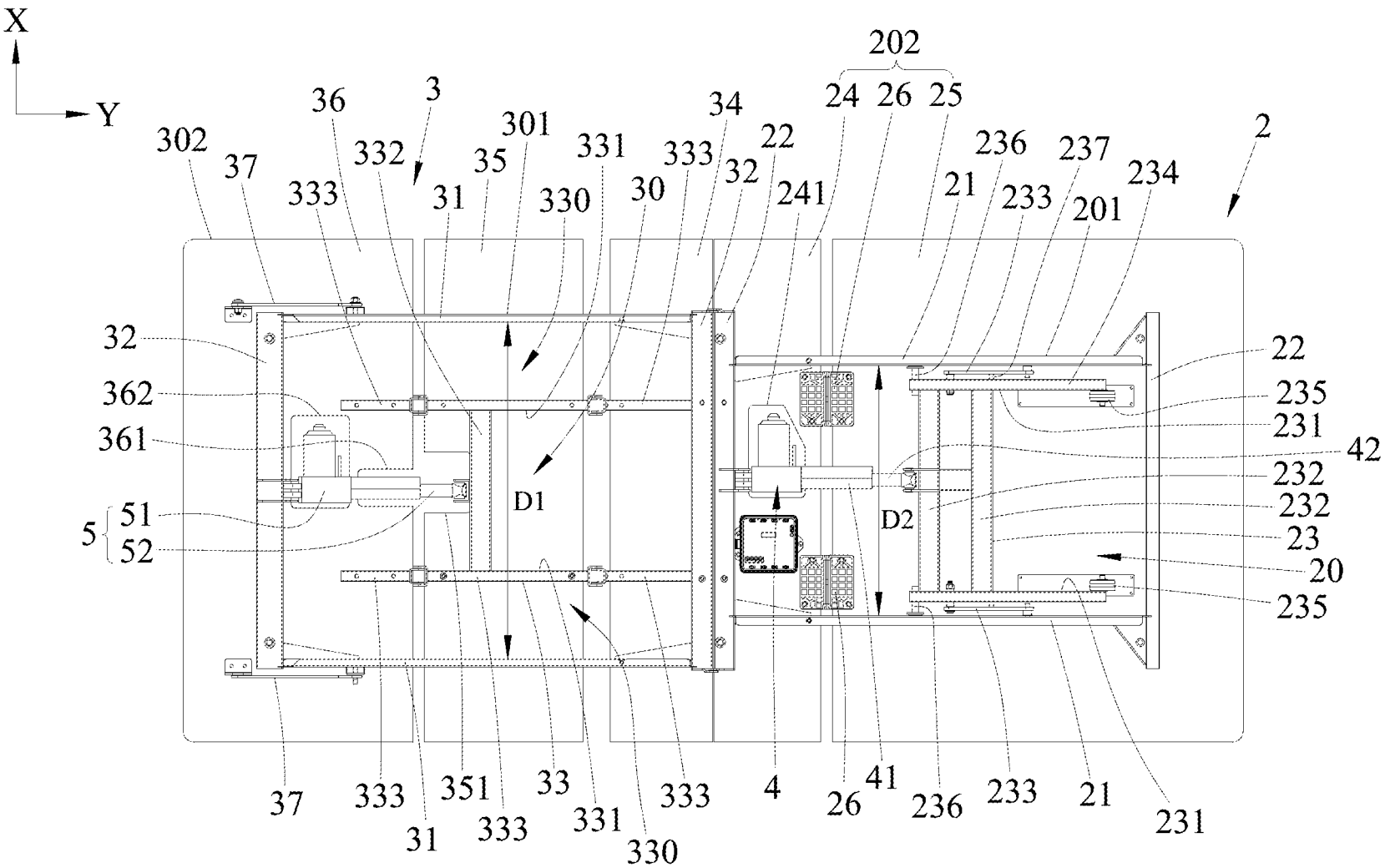
FIG. 4 is a bottom view of the embodiment.
Figure 5:
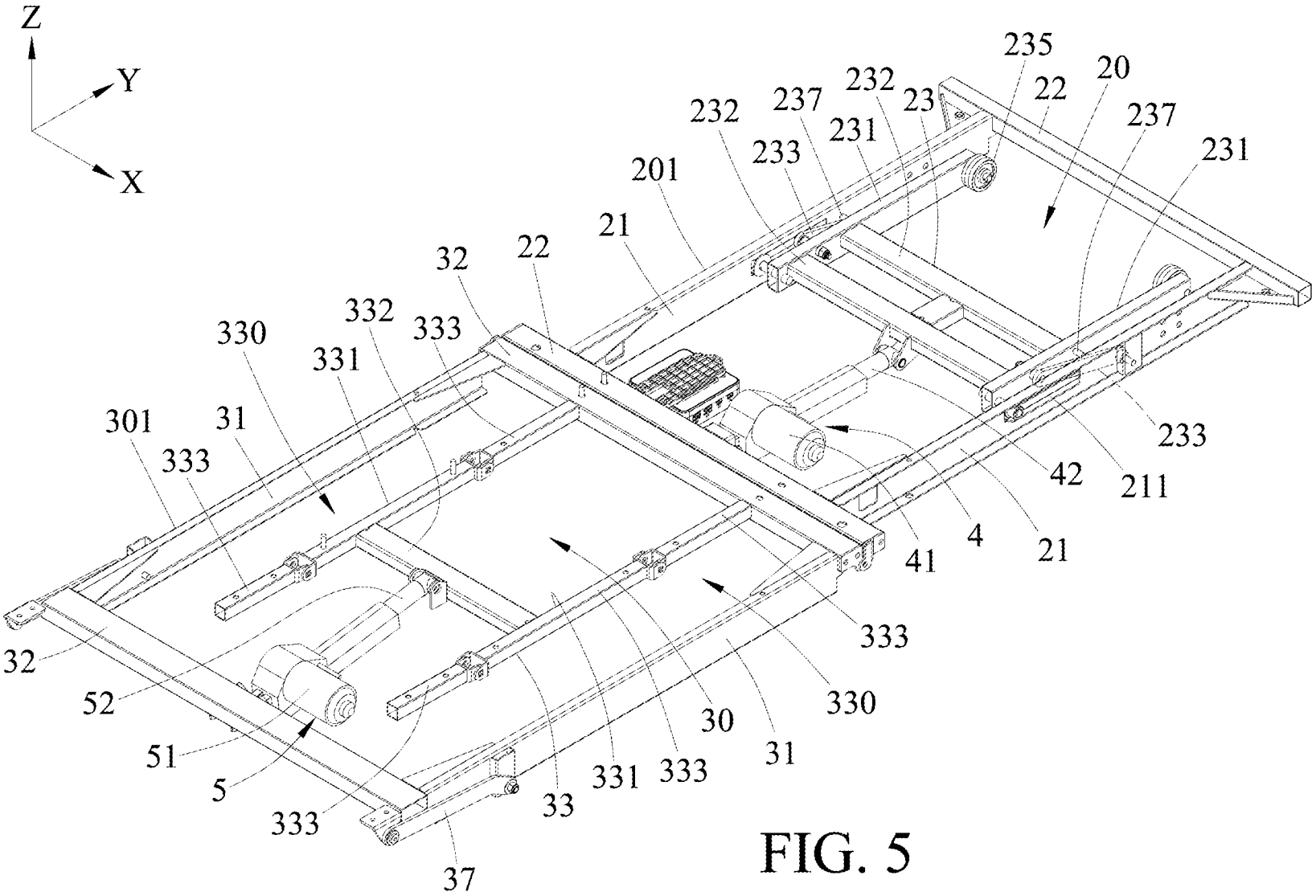
FIG. 5 is a perspective view of the embodiment, with a first panel assembly and a second panel assembly being removed for the sake of clarity.

Referring to FIGS. 3 to 5, an embodiment of a foldable bed according to the disclosure includes a first frame unit 2, a second frame unit 3, a first electric driver 4 and a second electric driver 5. A mattress (not shown) may be mounted on the first and second frame units 2, 3 in use.

The first frame unit 2 includes a first frame 201 and a first panel assembly 202. The first frame 201 has two first outboard rods 21 which are spaced apart from each other in a left-right direction (X) and each of which extends in a front-rear direction (Y) to have front and rear ends, two first overlapping rods 22 which respectively interconnect the front ends and the rear ends of the first outboard rods 21, and a first inboard frame assembly 23 which is surrounded by the first outboard rods 21 and the first overlapping rods 22. In the embodiment, each first outboard rod 21 is an integrally formed U channel bar and has a height which is measured in an up-down direction (Z) and which is 60 mm. Each first outboard rod 21 has a sliding slot 211 which penetrates therethrough in the left-right direction (X) and which extends in the front-rear direction (Y). The left-right direction (X), the front-rear direction (Y) and the up-down direction (Z) are perpendicular to one another. Each first overlapping rod 22 is a hollow rectangular tube.

The first inboard frame assembly 23 has two first inboard rods 231 which extend in the front-rear direction (Y), two first crosspieces 232 which extend in the left-right direction (X) to interconnect the first inboard rods 231, and two first linking members 233, each of which is linked to a respective one of the first inboard rods 231 and an adjacent one of the first outboard rods 21. The first frame 201 defines therein a first receiving space 20 which is bordered by the first inboard frame assembly 23 and one of the first overlapping rods 22 at the front ends of the first outboard rods 21. In other embodiments, the number of the first crosspieces 232 may be only one. Each of the first inboard rods 231 and the first crosspieces 232 is a hollow rectangular tube.

Figure 6:
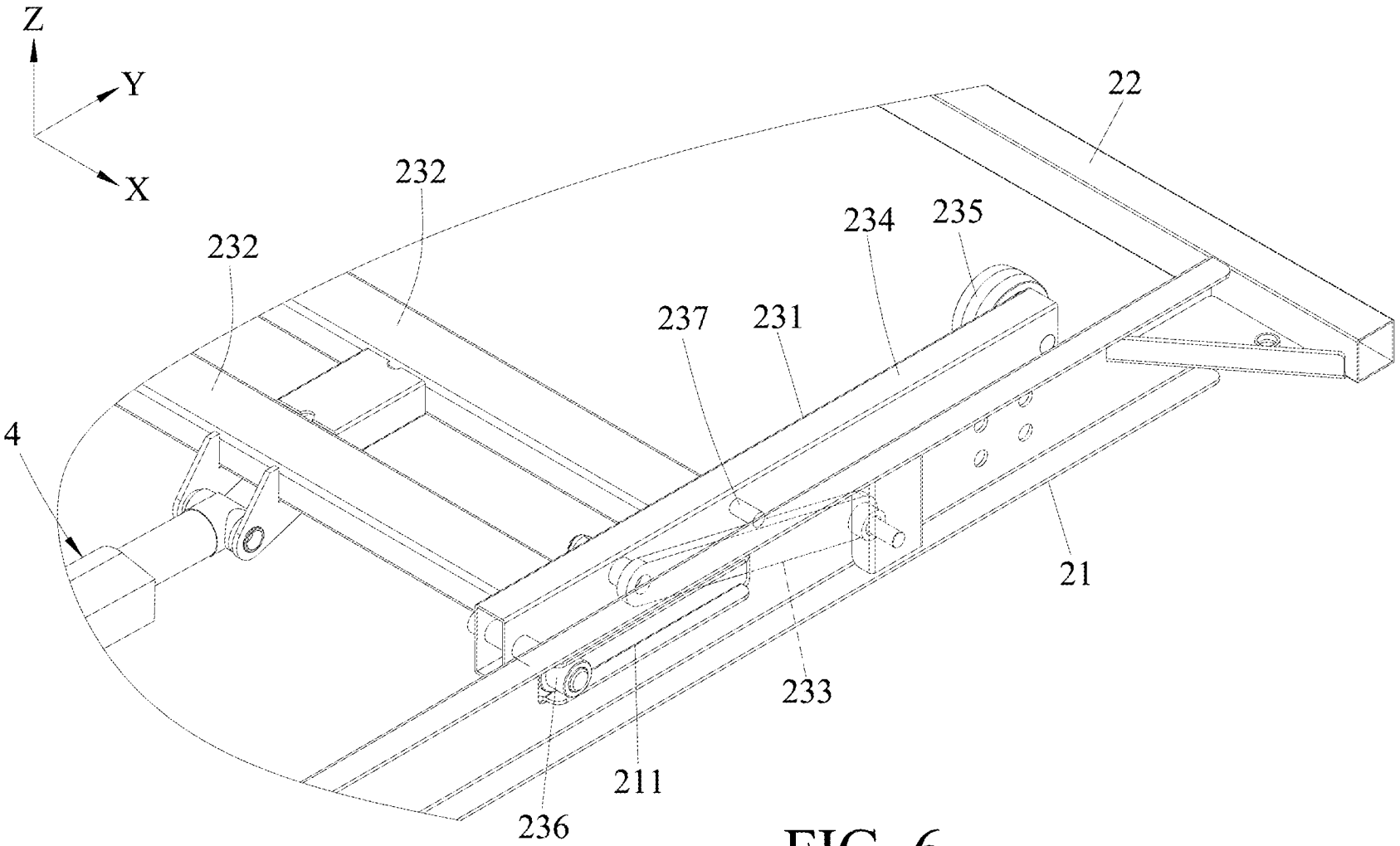
FIG. 6 is a schematic enlarged view of FIG. 5.

With reference to FIGS. 4 and 6, specifically, each first inboard rod 231 has a first rod body 234 extending in the front-rear direction (Y), a roller 235 disposed on a front end of the first rod body 234 and rollably attached to the first panel assembly 202, a sliding piece 236 disposed on a rear end of the first rod body 234 and slidably engaged in the corresponding sliding slot 211, and a pin 237 disposed on the first rod body 234 and interposed between the roller 235 and the sliding piece 236. Through the sliding piece 236 being slidably engaged in the corresponding sliding slot 211, the rear end of each first inboard rod 231 is slidably disposed in the sliding slot 211 of the respective first outboard rod 21.

Figure 7:
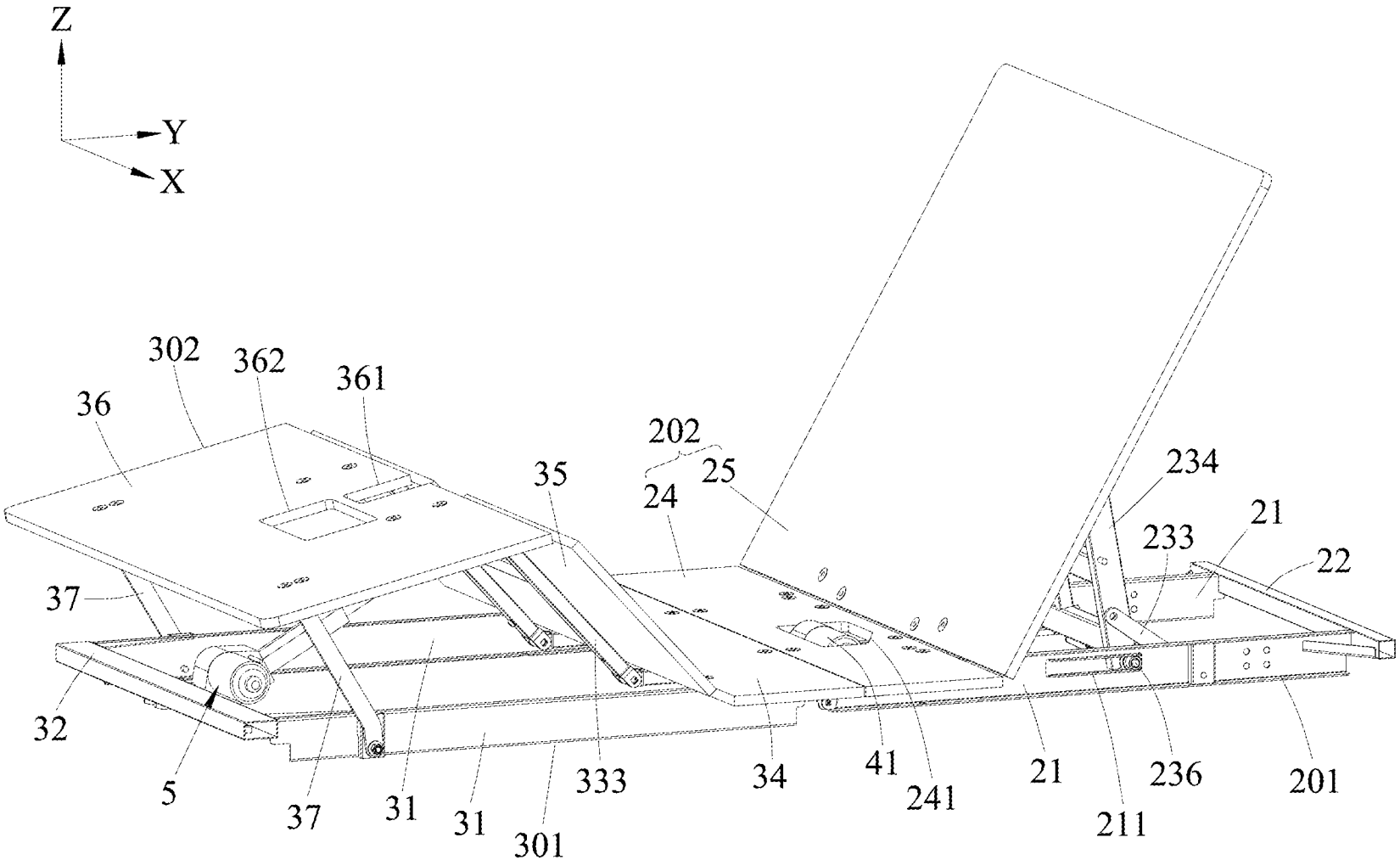
FIG. 7 is a perspective view of the embodiment in a state when the first panel assembly and the second panel assembly are rotated.

With reference to FIGS. 3, 4 and 7, the first panel assembly 202 is disposed and supported on the first frame 201 in the up-down direction (Z). The first panel assembly 202 has a first fixed panel 24 which is securely mounted on the first frame 201, a first bed panel 25 which is disposed adjacent to the first fixed panel 24 and rotatable relative to the first fixed panel 24, and two connecting plates 26 which are connected between the first fixed panel 24 and the first bed panel 25 and spaced apart from each other in the left-right direction (X). The first fixed panel 24 has a first opening 241. Specifically, a rear side of the first fixed panel 24 is fastened to the first overlapping rod 22 at the rear end, and a front side thereof is fastened to the first outboard rods 21. The rollers 235 of the first inboard rods 231 are rollably attached to the first bed panel 25. Through the foldable connecting plates 26, the first bed panel 25 is rotatable relative to the first fixed panel 24 and movable relative to the first frame 201.

With reference to FIGS. 3 to 5, the second frame unit 3 is connected with a rear side of the first frame unit 2 in the front-rear direction (Y). The second frame unit 3 includes a second frame 301 and a second panel assembly 302. The second frame 301 has two second outboard rods 31, each of which extends in the front-rear direction (Y) to have front and rear ends, two second overlapping rods 32 which respectively interconnect the front ends and the rear ends of the second outboard rods 31, and a second inboard frame assembly 33 which is surrounded by the second outboard rods 31 and the second overlapping rods 32. The second frame 301 defines therein a second receiving space 30 which is bordered by the second inboard frame assembly 33 and one of the second overlapping rods 32 at the front ends of the second outboard rods 31. Each second outboard rod 31 has a height measured in the up-down direction (Z) and ranging from 55 mm to 65 mm. In this embodiment, the height of each second outboard rod 31 is 60 mm. Each second outboard rod 31 is an integrally formed U channel bar, and the height of each second outboard rod 31 is the same as that of each first outboard rod 21. As shown in FIG. 4, the second outboard rods 31 are spaced apart from each other in the left-right direction (X) by a distance (D1) which is larger than a distance (D2) between the first outboard rods 21.

The second inboard frame assembly 33 has two second inboard rods 331 which extend in the front-rear direction (Y), and a second crosspiece 332 which extends in the left-right direction (X) to interconnect the second inboard rods 331. Each second outboard rod 31 is spaced apart from an adjacent one of the second inboard rods 331 to define a rod receiving space 330 therebetween.

The second panel assembly 302 is disposed and supported on the second frame 301 in the up-down direction (Z). The second panel assembly 302 has a second fixed panel 34 which is securely mounted on the second frame 301 and adjacent to the first fixed panel 24, a second bed panel 35 which is disposed adjacent to the second fixed panel 34 and rotatable relative to the second fixed panel 34, and a distal panel 36 which is disposed adjacent to the second bed panel 35 and rotatable relative to the second bed panel 35. The second bed panel 35 has a rear opening 351 opened rearwardly. The distal panel 36 has a front opening 361 opened forwardly, and a second opening 362 at a rear side of the front opening 361. The front opening 361 is in spatial communication with the rear opening 351.

Further, each second inboard rod 331 has three second rod bodies 333 which are respectively and securely mounted on the second fixed panel 34, the second bed panel 35 and the distal panel 36 and which are pivotable relative to one another.

With reference to FIGS. 4, 5 and 7, the second frame 301 further has two second linking members 37, each of which is linked to a respective one of the second outboard rods 31 and the distal panel 36. Through the second linking members 37, the distal panel 36 is rotatable relative to the second bed panel 35 to bring the second rod bodies 333 to pivot relative to each other, which results in rotation of the second bed panel 35 relative to the second fixed panel 34 and movement relative to the second frame 301.

Figure 8:
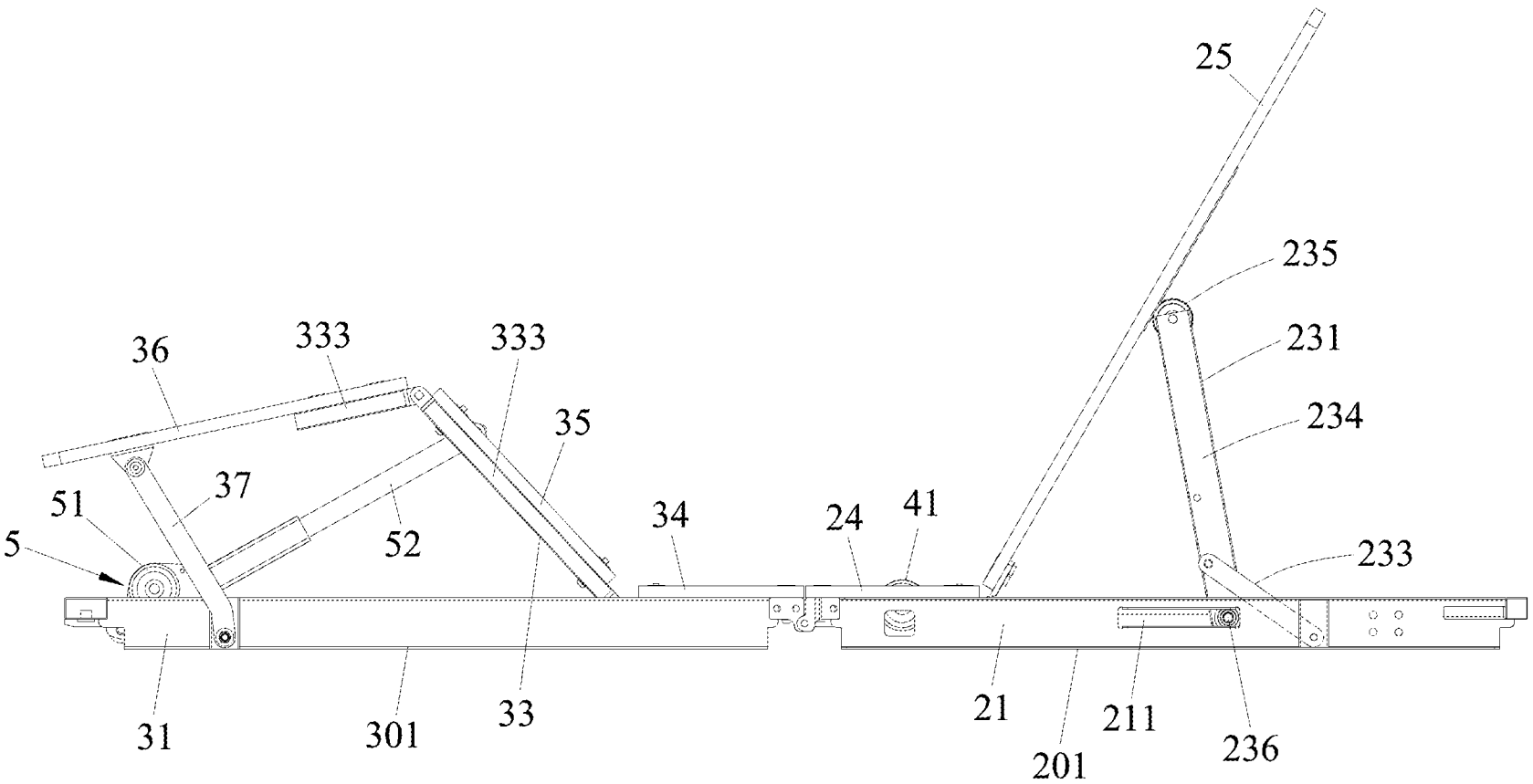
FIG. 8 is a side view of FIG. 7.

With reference to FIGS. 4, 7 and 8, the first electric driver 4 is actuated by electric power, and is disposed on the first frame 201 between the first crosspieces 232 and the rear first overlapping rod 22. The first electric driver 4 has a first driver body 41 which is securely disposed on the rear first overlapping rod 22, and a first piston rod 42 which extends from the first driver body 41 and securely connected with the first crosspieces 232. A portion of the first driver body 41 is exposed from the first opening 241. The first electric driver 4 is actuated to drive the movement of the first inboard frame assembly 23 so as to bring the first bed panel 25 into rotation relative to the first fixed panel 24.

In this embodiment, the first electric driver 4 is actuated by electric power to extend the first piston rod 42 forwardly so as to move the first inboard frame assembly 23. The sliding pieces 236 slide forwardly along the sliding slots 211, and the first linking members 233 are pivoted relative to the first outboard rods 21 so as to raise the first rod bodies 234 and permit sliding of the rollers 235 along the first bed panels 25. The rear ends of the first inboard rods 231 are raised to bring the first bed panel 25 to rotate relative to the first fixed panel 24. The first bed panel 25 in this state may serve as a backrest for the user. The first electric driver 4 is actuated to retract the first piston rod 42 toward the first driver body 41 so as to lower the first inboard rods 231 to move the first bed panel 25 back to the horizontal flat state.

With reference to FIGS. 3 to 5, the second electric driver 5 is actuated by electric power, and is disposed on the second frame 301 between the second crosspiece 332 and the rear second overlapping rod 32. The second electric driver 5 has a second driver body 51 which is securely disposed on the rear second overlapping rod 32, and a second piston rod 52 which extends from the second driver body 51 and is securely connected with the second crosspiece 332. A portion of the second driver body 51 is exposed from the second opening 362. The second electric driver 5 is actuated to drive the movement of the second inboard frame assembly 33 so as to bring the second bed panel 35 and the distal panel 36 into rotation relative to the second fixed panel 34.

With reference to FIGS. 4, 7 and 8, in this embodiment, the second electric driver 5 is actuated by electric to extend the second piston rod 52 forwardly so as to move the second inboard frame assembly 33. The second linking members 37 are pivoted relative to the second outboard rods 31 so as to raise the distal panel 36 and bring the second bed panel 35 to rotate relative to the second fixed panel 34. The user lying on the bed can rest his/her legs on the second bed panel 35 and the distal panel 36 in a knee bending posture. The rear opening 351 and the front opening 361 are formed for permitting extension of the first piston rod 42.

Figure 9:
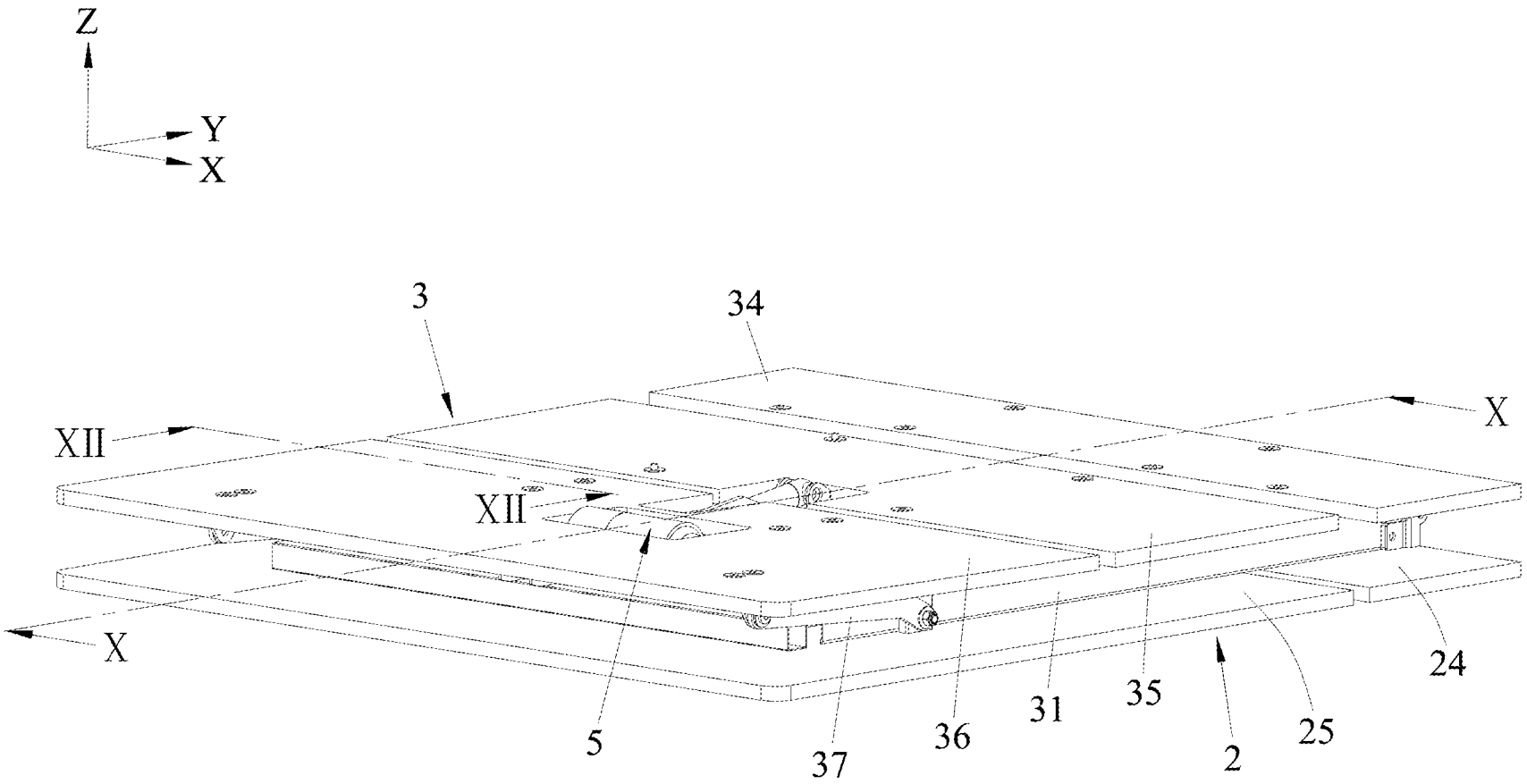
FIG. 9 is a perspective view illustrating the embodiment in a folded state.
Figure 10:
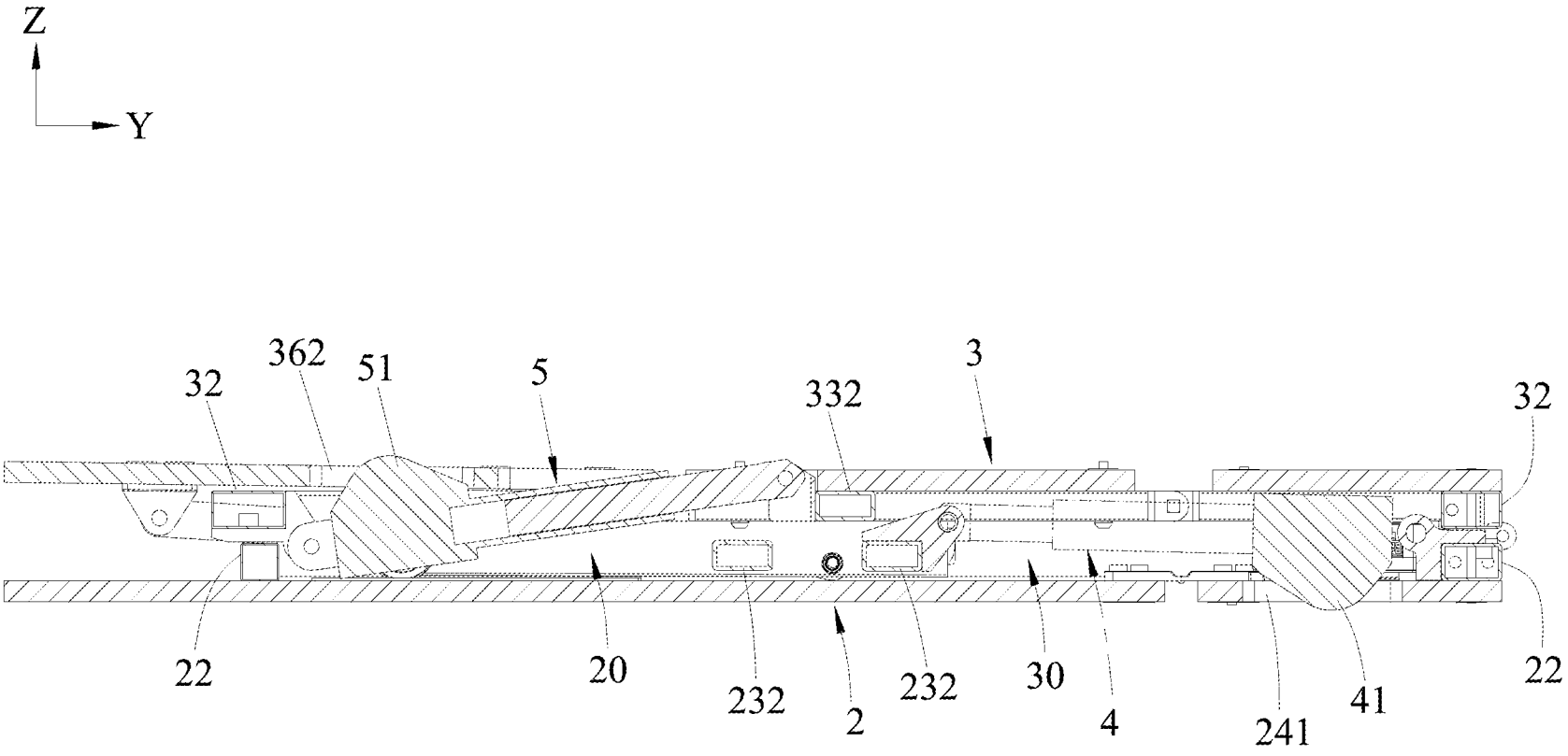
FIG. 10 is a sectional view taken along line X-X of FIG. 9.
Figure 11:
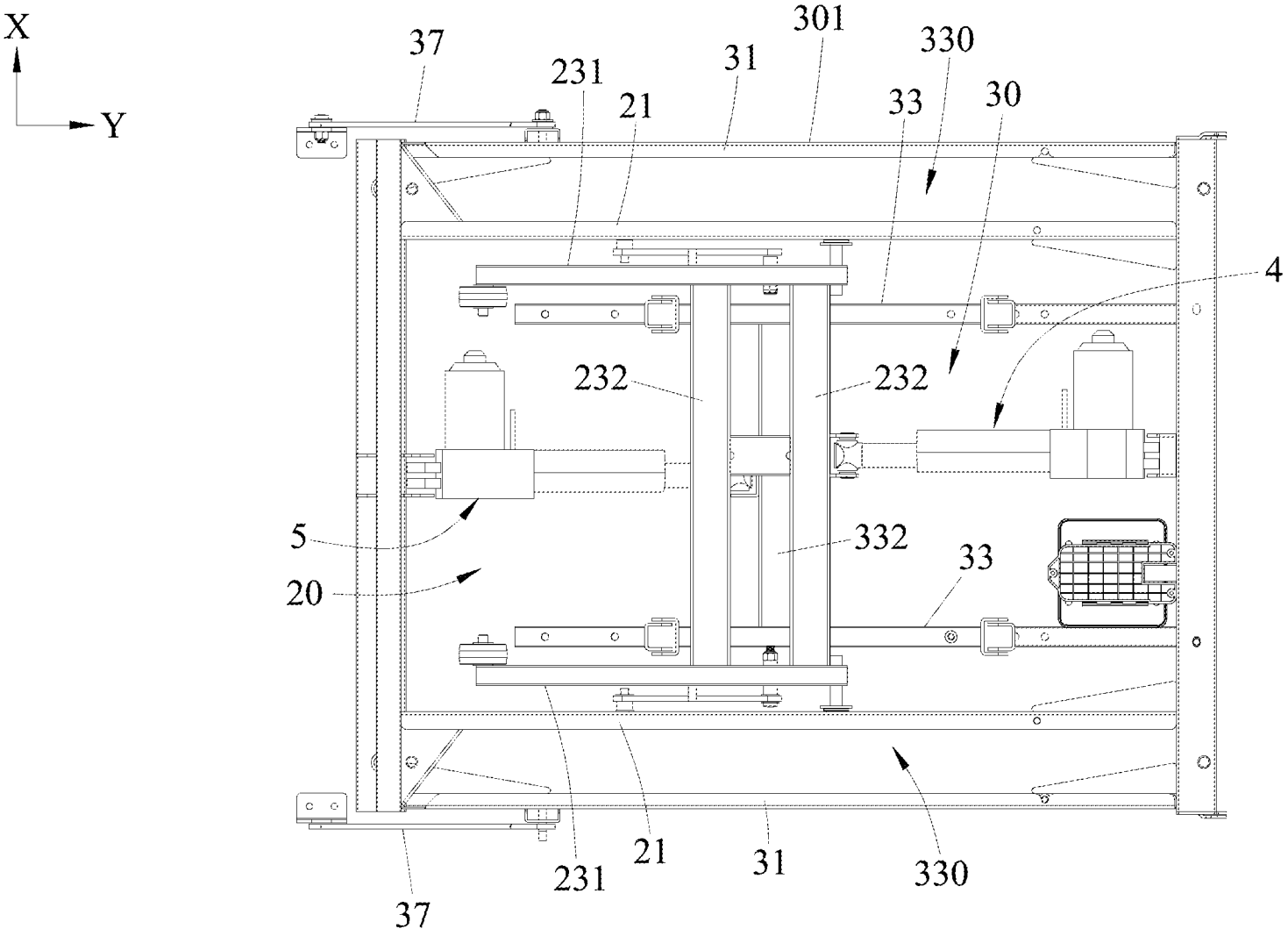
FIG. 11 is a bottom view of the embodiment in the folded state, with the first panel assembly and the second panel assembly being removed for the sake of clarity.

With reference to FIGS. 3 and 9, the first and second frame units 2, 3 are shiftable between an unfolded state (see FIG. 3), where the first and second frame units 2, 3 are spreaded relative to each other in the front-rear direction (Y), and a folded state (see FIG. 9), where the first and second frame units 2, 3 are overlapped with each other in the up-down direction (Z). With reference to FIGS. 3, 5 and 6, in the unfolded state, the pin 237 of each first frame 201 abuts against the adjacent first linking member 233. With reference to FIGS. 9 to 11, in the folded state, each first outboard rod 21 and the adjacent first inboard rod 231 are received in the corresponding rod receiving space 330, the first electric driver 4 is received in the second receiving space 30 and has a portion exposed from the first opening 241, and the second electric driver 5 is received in the first receiving space 20 and has a portion exposed from the second opening 362. Moreover, the first and second crosspieces 232, 332 are spaced apart from each other in the up-down direction (Z), and the first overlapping rods 22 are overlapped with the second overlapping rods 32 in the up-down direction (Z), respectively.

Figure 12:
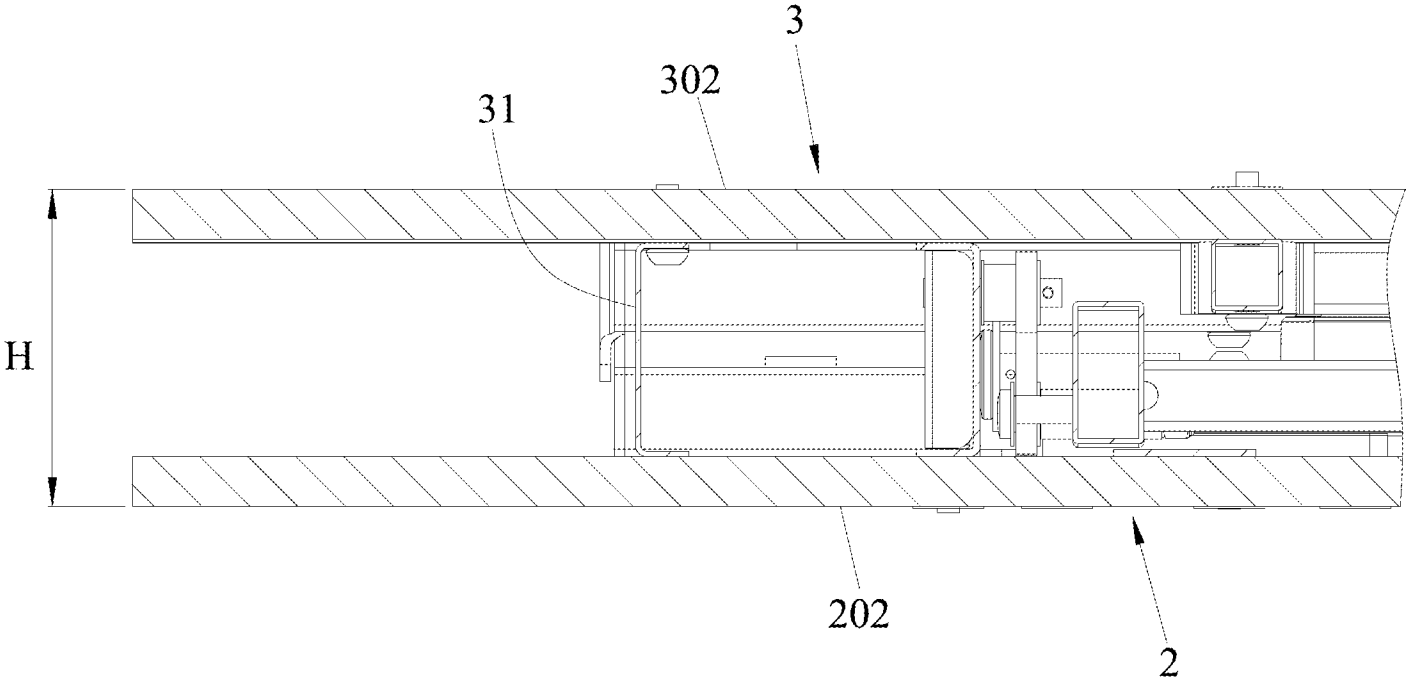
FIG. 12 is a sectional view taken along line XII-XII of FIG. 9.

With reference to FIG. 12, in the folded state, the first and second frame units 2, 3 define a folded height (H) which is measured in the up-down direction (Z) and which is the sum of a height of one of the second outboard rods 31, a height of the first panel assembly 202 and a height of the second panel assembly 302.

As compared with the prior art in which the frame halves are overlapped with each other, in this embodiment, since the distance (D1) between the second outboard rods 31 is larger than the distance (D2) between the first outboard rods 21, the first and second frames 201, 301 are not registered with each other when folded, the first outboard rods 21 and the first inboard rods 231 are received in the rod receiving spaces 330, and the folded height (H) of the foldable bed is reduced so as to reduce the packaging volume and transportation and storage costs.

In some embodiments, the first panel assembly 202 and the second panel assembly 302 are exchanged with each other. Alternatively, the second panel assembly 302 may be fixed on the second frame 301 and the second electric driver 5 may be omitted. With the first outboard rods 21 and the first inboard rods 231 received in the rod receiving spaces 330, the folded height (H) is reduced when the first and second frame units 2, 3 are in the folded state so as to reduce the packaging volume and transportation and storage costs.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A foldable bed, comprising:

a first frame unit including:

a first frame having two first outboard rods which are spaced apart from each other in a left-right direction and each of which extends in a front-rear direction to have front and rear ends, two first overlapping rods which respectively interconnect said front ends and said rear ends of said first outboard rods, and a first inboard frame assembly which is surrounded by said first outboard rods and said first overlapping rods, said first inboard frame assembly having two first inboard rods which extend in the front-rear direction, and at least one first crosspiece which extends in the left-right direction to interconnect said first inboard rods, and a first panel assembly disposed and supported on said first frame in an up-down direction;

a second frame unit connected with said first frame unit in the front-rear direction, and including:

a second frame having two second outboard rods, each of which extends in the front-rear direction to have front and rear ends and has a height measured in the up-down direction and ranging from 55 mm to 65 mm, two second overlapping rods which respectively interconnect said front ends and said rear ends of said second outboard rods, and a second inboard frame assembly which is surrounded by said second outboard rods and said second overlapping rods, said second outboard rods being spaced apart from each other in the left-right direction by a distance which is larger than a distance between said first outboard rods, said second inboard frame assembly having two second inboard rods which extend in the front-rear direction, and a second crosspiece which extends in the left-right direction to interconnect said second inboard rods, each of said second outboard rods being spaced apart from an adjacent one of said second inboard rods to define a rod receiving space therebetween, and a second panel assembly disposed and supported on said second frame in the up-down direction;

a first electric driver actuated to drive movement of said first panel assembly or said second panel assembly, said first electric driver being interposed between said first crosspiece and one of said first overlapping rods at said rear ends of said first outboard rods; and a second electric driver disposed on said second frame for driving movement of said second inboard frame assembly to rotate said second bed panel and said distal panel relative to said second fixed panel, said second electric driver being interposed between said second crosspiece and one of said second overlapping rods at said rear ends of said second outboard rods, wherein, said first and second frame units are shiftable between an unfolded state, where said first and second frame units are spreaded relative to each other in the front-rear direction, and a folded state, where said first and second frame units are overlapped with each other in the up-down direction, and each of said first outboard rods and an adjacent one of said first inboard rods are received in said rod receiving space, and wherein, in the folded state, said first and second frame units define a folded height which is measured in the up-down direction and which is a sum of a height of one of said second outboard rods, a height of said first panel assembly and a height of said second panel assembly.

2. The foldable bed of claim 1, wherein said first panel assembly has a first fixed panel which is securely mounted on said first frame, and a first bed panel which is disposed adjacent to said first fixed panel and rotatable relative to said first fixed panel, said second panel assembly having a second fixed panel which is securely mounted on said second frame and adjacent to said first fixed panel, a second bed panel which is disposed adjacent to said second fixed panel and rotatable relative to said second fixed panel, and a distal panel which is disposed adjacent to said second bed panel and rotatable relative to said second bed panel, said first electric driver being disposed on said first frame for driving movement of said first inboard frame assembly to rotate said first bed panel relative to said first fixed panel;

said first frame defining a first receiving space which is bordered by said first inboard frame assembly and one of said first overlapping rods at said front ends of said first outboard rods, said second frame defining a second receiving space which is bordered by said second inboard frame assembly and one of said second overlapping rods at said front ends of said second outboard rods, wherein, in the folded state, said first electric driver is received in said second receiving space and said second electric driver is received in said first receiving space.

3. The foldable bed of claim 1, wherein said first and second crosspieces are spaced apart from each other in the up-down direction when said first and second frame units are in the folded state.

4. The foldable bed of claim 2, wherein said first fixed panel has a first opening for a portion of said first electric driver to be exposed therefrom, said distal panel having a second opening for a portion of said second electric driver to be exposed therefrom.

5. The foldable bed of claim 1, wherein the height of each of said second outboard rods is 60 mm.

6. The foldable bed of claim 1, wherein each of said first outboard rods is in form of an integrally formed channel bar, and each of said second outboard rods is in form of an integrally formed channel bar, and has the height which is the same as that of each of said first outboard rods.

7. A foldable bed, comprising:

a first frame unit including:

a first frame having two first outboard rods which are spaced apart from each other in a left-right direction and each of which extends in a front-rear direction to have front and rear ends, two first overlapping rods which respectively interconnect said front ends and said rear ends of said first outboard rods, and a first inboard frame assembly which is surrounded by said first outboard rods and said first overlapping rods, said first inboard frame assembly having two first inboard rods which extend in the front-rear direction, and a first panel assembly disposed and supported on said first frame in an up-down direction;

a second frame unit connected with said first frame unit in the front-rear direction, and including:

a second frame having two second outboard rods, each of which extends in the front-rear direction to have front and rear ends and has a height measured in the up-down direction and ranging from 55 mm to 65 mm, two second overlapping rods which respectively interconnect said front ends and said rear ends of said second outboard rods, and a second inboard frame assembly which is surrounded by said second outboard rods and said second overlapping rods, said second outboard rods being spaced apart from each other in the left-right direction by a distance which is larger than a distance between said first outboard rods, said second inboard frame assembly having two second inboard rods which extend in the front-rear direction, each of said second outboard rods being spaced apart from an adjacent one of said second inboard rods to define a rod receiving space therebetween, and a second panel assembly disposed and supported on said second frame in the up-down direction; and a first electric driver actuated to drive movement of said first panel assembly or said second panel assembly, wherein, said first and second frame units are shiftable between an unfolded state, where said first and second frame units are spreaded relative to each other in the front-rear direction, and a folded state, where said first and second frame units are overlapped with each other in the up-down direction, and each of said first outboard rods and an adjacent one of said first inboard rods are received in said rod receiving space, and wherein, in the folded state, said first and second frame units define a folded height which is measured in the up-down direction and which is a sum of a height of one of said second outboard rods, a height of said first panel assembly and a height of said second panel assembly, wherein, each of said first outboard rods has a sliding slot which penetrates therethrough in the left-right direction, each of said first inboard rods having one end which is slidably engaged in said sliding slot, and the other end which is rollably attached to said first panel assembly, said first inboard frame assembly further having two first linking members, each of which is linked to a respective one of said first inboard rods and an adjacent one of said first outboard rods such that, when said first electric driver is actuated to move the first inboard frame assembly along said sliding slots, said other ends of said first inboard rods are raised or lowered through pivoting of said first linking members.

8. The foldable bed of claim 7, wherein each of said first inboard rods has a first rod body extending in the front-rear direction, a roller disposed on a front end of said first rod body and rollably attached to said first panel assembly, a sliding piece disposed on a rear end of said first rod body and slidably engaged in said sliding slot, a pin disposed on said first rod body and interposed between said roller and said sliding piece such that, when said first and second frame units are in the unfolded state, said pin abuts against an adjacent one of said first linking members.

9. A foldable bed, comprising:

a first frame unit including:

a first frame having two first outboard rods which are spaced apart from each other in a left-right direction and each of which extends in a front-rear direction to have front and rear ends, two first overlapping rods which respectively interconnect said front ends and said rear ends of said first outboard rods, and a first inboard frame assembly which is surrounded by said first outboard rods and said first overlapping rods, said first inboard frame assembly having two first inboard rods which extend in the front-rear direction, said first frame defining a first receiving space which is bordered by said first inboard frame assembly and one of said first overlapping rods at said front ends of said first outboard rods, and a first panel assembly disposed and supported on said first frame in an up-down direction, said first panel assembly having a first fixed panel which is securely mounted on said first frame, and a first bed panel which is disposed adjacent to said first fixed panel and rotatable relative to said first fixed panel;

a second frame unit connected with said first frame unit in the front-rear direction, and including:

a second frame having two second outboard rods, each of which extends in the front-rear direction to have front and rear ends and has a height measured in the up-down direction and ranging from 55 mm to 65 mm, two second overlapping rods which respectively interconnect said front ends and said rear ends of said second outboard rods, and a second inboard frame assembly which is surrounded by said second outboard rods and said second overlapping rods, said second outboard rods being spaced apart from each other in the left-right direction by a distance which is larger than a distance between said first outboard rods, said second inboard frame assembly having two second inboard rods which extend in the front-rear direction, each of said second outboard rods being spaced apart from an adjacent one of said second inboard rods to define a rod receiving space therebetween, said second frame defining a second receiving space which is bordered by said second inboard frame assembly and one of said second overlapping rods at said front ends of said second outboard rods, and a second panel assembly disposed and supported on said second frame in the up-down direction, said second panel assembly having a second fixed panel which is securely mounted on said second frame and adjacent to said first fixed panel, a second bed panel which is disposed adjacent to said second fixed panel and rotatable relative to said second fixed panel, and a distal panel which is disposed adjacent to said second bed panel and rotatable relative to said second bed panel; and a first electric driver disposed on said first frame for driving movement of said first inboard frame assembly to rotate said first bed panel relative to said first fixed panel; and a second electric driver disposed on said second frame for driving movement of said second inboard frame assembly to rotate said second bed panel and said distal panel relative to said second fixed panel;

wherein, said first and second frame units are shiftable between an unfolded state, where said first and second frame units are spreaded relative to each other in the front-rear direction, and a folded state, where said first and second frame units are overlapped with each other in the up-down direction, and each of said first outboard rods and an adjacent one of said first inboard rods are received in said rod receiving space, wherein, in the folded state, said first and second frame units define a folded height which is measured in the up-down direction and which is a sum of a height of one of said second outboard rods, a height of said first panel assembly and a height of said second panel assembly, and, in the folded state, said first electric driver is received in said second receiving space and said second electric driver is received in said first receiving space, wherein, each of said second inboard rods has three second rod bodies which are respectively and securely mounted on said second fixed panel, said second bed panel and said distal panel and which are pivotable relative to one another, said second frame further having two second linking members, each of which is linked to a respective one of said second outboard rods and said distal panel such that, when said second electric driver is actuated to move the second inboard frame assembly, said second linking members are pivoted relative to said second outboard rods to raise or lower said distal panel and to rotate said second bed panel.

* * * * *